US005453679A

United States Patent [19]

Rapp

[11] Patent Number: 5,453,679

[45] Date of Patent: Sep. 26, 1995

[54] BANDGAP VOLTAGE AND CURRENT GENERATOR CIRCUIT FOR GENERATING CONSTANT REFERENCE VOLTAGE INDEPENDENT OF SUPPLY VOLTAGE, TEMPERATURE AND SEMICONDUCTOR PROCESSING

[75] Inventor: A. Karl Rapp, Los Gatos, Calif.

[73] Assignee: National Semiconductor Corporation, Del.

[21] Appl. No.: 241,491

[22] Filed: May 12, 1994

[51] Int. Cl.[6] ..... G05F 3/16

[52] U.S. Cl. ..... 323/313; 323/315

[58] Field of Search ..... 323/313, 314, 323/315, 316, 317, 901; 307/296.1, 296.6, 310; 330/256, 257, 288, 289

[56] References Cited

U.S. PATENT DOCUMENTS

| | | | |
|---|---|---|---|
| 4,287,439 | 9/1981 | Leuschner | 307/310 |
| 4,816,742 | 3/1989 | van de Plassche | 323/316 |
| 4,935,690 | 6/1990 | Yan | 323/314 |
| 5,063,342 | 11/1991 | Hughes et al. | 323/907 |
| 5,229,710 | 6/1993 | Kraus et al. | 323/313 |
| 5,291,122 | 3/1994 | Audy | 323/313 |

*Primary Examiner*—Steven L. Stephan
*Assistant Examiner*—Matthew V. Nguyen
*Attorney, Agent, or Firm*—Limbach & Limbach; H. Donald Nelson; Vincenzo D. Pitruzzella

[57] ABSTRACT

A bandgap constant voltage circuit employs a resistor network to pass the currents conducted by a pair of PN junction transistors. These two transistors are operated at differential current densities. A resistor is connected in series with the lower current density transistor. A comparator has its input terminals coupled to the circuit nodes representing the higher current density transistor and the combined lower current density transistor and series-connected resistor. The comparator output is a current that is coupled to the resistor network which is proportioned with respect to the series-connected resistor to produce a voltage that, when combined with the voltage drop across the high current density transistor, is equal to the semiconductor bandgap. A negative feedback loop, employing re-entrant connected current mirrors, is employed to adjust all of the circuit currents and is incorporated into the comparator so that the voltage applied to the resistor network is maintained at the bandgap value. The circuit described also produces P-channel and N-channel transistor reference voltages. A start-up circuit ensures that, when power is applied, the circuit will be forced to conduct its designed currents. If desired, the start-up circuit can be disabled by a control potential.

9 Claims, 2 Drawing Sheets

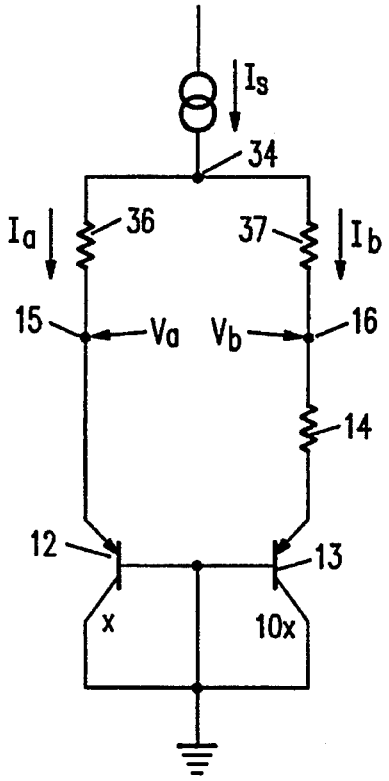
FIG. 1A
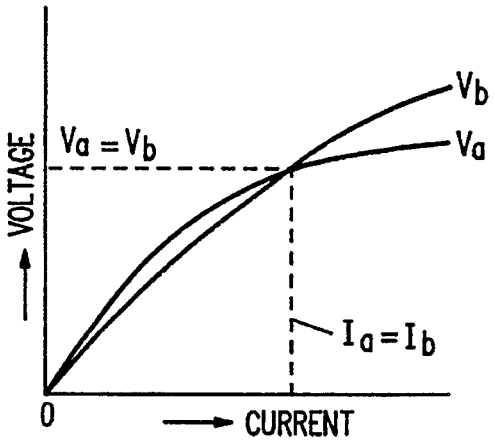
FIG. 1B
FIG. 4
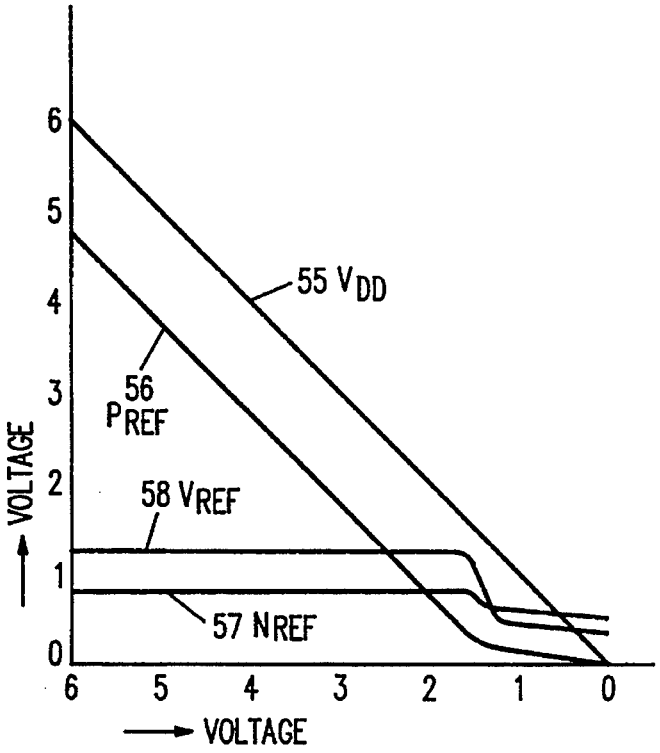

BANDGAP VOLTAGE AND CURRENT GENERATOR CIRCUIT FOR GENERATING CONSTANT REFERENCE VOLTAGE INDEPENDENT OF SUPPLY VOLTAGE, TEMPERATURE AND SEMICONDUCTOR PROCESSING

BACKGROUND OF THE INVENTION

1. Field of the Invention

The present invention relates to a bandgap voltage and current reference generator circuit wherein two inter-dependent feedback loops around a current-output comparator are used to simultaneously generate voltage and current references, thereby supporting operation down to very low supply voltages.

2. Discussion of the Prior Art

Bandgap references are well known for obtaining a reference voltage that is relatively constant over a substantial temperature range. The basic concept is to combine two potentials, one having a positive temperature coefficient and one having a negative temperature coefficient. The sum of these two potentials is made equal to the semiconductor bandgap potential extrapolated to absolute zero temperature. For silicon, this value is close to 1.2 volts.

Typically, the negative temperature coefficient potential is obtained from a forward-biased PN junction, i.e., the emitter-base junction in a conducting transistor operated at a current that will produce a voltage drop of about 600 mV at 300° K. This voltage has a negative temperature coefficient of about 2 mV/°C. The positive temperature coefficient is obtained from a $\Delta V_{BE}$-producing circuit that develops a 600 mV potential at about 300° K. This voltage has a positive temperature coefficient of about 2 mV/°C. Thus, when these two voltages are combined at 300° K., a 1.2 V potential is produced with close to zero temperature coefficient.

The $\Delta V_{BE}$ potential is typically produced by operating a pair of transistors at substantially different current densities. This can be done by ratioing the transistor areas and passing equal currents, or by using matched area devices and ratioing the currents. If desired, a combination of transistor size and current ratioing can be employed. The low-current-density transistor includes a series resistor. The two devices are equivalently connected in parallel so that the differential voltage drop ($\Delta V_{BE}$) appears across the resistor. Typically, at 300° K. and a current-density ratio of 10, the $\Delta V_{BE}$ will be about 60 mV. This value, when multiplied by 10, produces a voltage of about 600 mV having a positive temperature coefficient.

SUMMARY OF THE INVENTION

The present invention provides a temperature-constant bandgap reference-voltage generating circuit that operates at very low supply voltage and produces constant-current references.

A bandgap voltage and current generator in accordance with the present invention includes a pair of PN junctions that are ratioed in area and provided with equal currents by means of a resistor network. The larger area device includes a series resistor across which a $\Delta V_{BE}$ is developed. The potential produced by the larger area device, in series with the $\Delta V_{BE}$ potential, is coupled to one input of a comparator that functions as a differential amplifier capable of operating at low supply voltage and with a current output. The potential developed across the smaller area device is coupled to the other comparator input. The comparator output current is applied to the resistor network, which as stated above, acts to set the currents in the ratioed PN junctions. The comparator, in combination with the resistor network and the ratioed current density PN junction devices, produces a constant output voltage which is independent of temperature, power-supply voltage and silicon processing over a relatively large range.

In the preferred embodiment of the invention, the comparator utilizes complimentary metal oxide semiconductor (CMOS) transistors operated in the enhancement mode. The comparator has two input transistors, the gates of which serve as inputs and the source terminals of which are connected together and to the drain of a current-source transistor. A plurality of re-entrant current mirrors are utilized to power the circuit. Equal constant-current load transistors are arranged to conduct at the same current level as the current-source transistor. Make-up current in the load transistors, which compensates for currents not delivered by the input transistors, is routed to diode-connected transistors which serve as current-mirror references. Current in one of these reference transistors is reduced in proportion to the current in the other reference transistor. This first, reduced-current transistor serves as the fundamental current-mirror reference for the entire circuit. As balance is sought by the comparator action, currents in all circuit elements are adjusted. Circuit elements are included to develop $P_{REF}$ and $N_{REF}$ current-mirror bias potentials. The circuit also includes a start-up section that responds to a $V_{DD}$ supply potential by initiating current flow. This start-up circuitry automatically restarts the bandgap reference if a noise glitch acts to kill the current.

Each path in the circuit between the supply rails contains less than two transistor threshold voltage drops. As a consequence, the circuit operates over a wide power supply voltage range, down to very low values.

A better understanding of the features and advantages of the various aspects of the invention will be obtained by reference to the following detailed description and accompanying drawings which set forth an illustrative embodiment in which the principles of the invention are utilized.

BRIEF DESCRIPTION OF THE DRAWINGS

FIG. 1A is a simplified schematic diagram illustrating the $\Delta V_{BE}$ portion of a circuit in accordance with the present invention.

FIG. 1B is a graph illustrating the voltage-current characteristics of the FIG. 1A circuit.

FIG. 4 is a graph illustrating the performance of the FIG. 2 circuit as a function of supply voltage.

DESCRIPTION OF THE INVENTION

Figure 2:
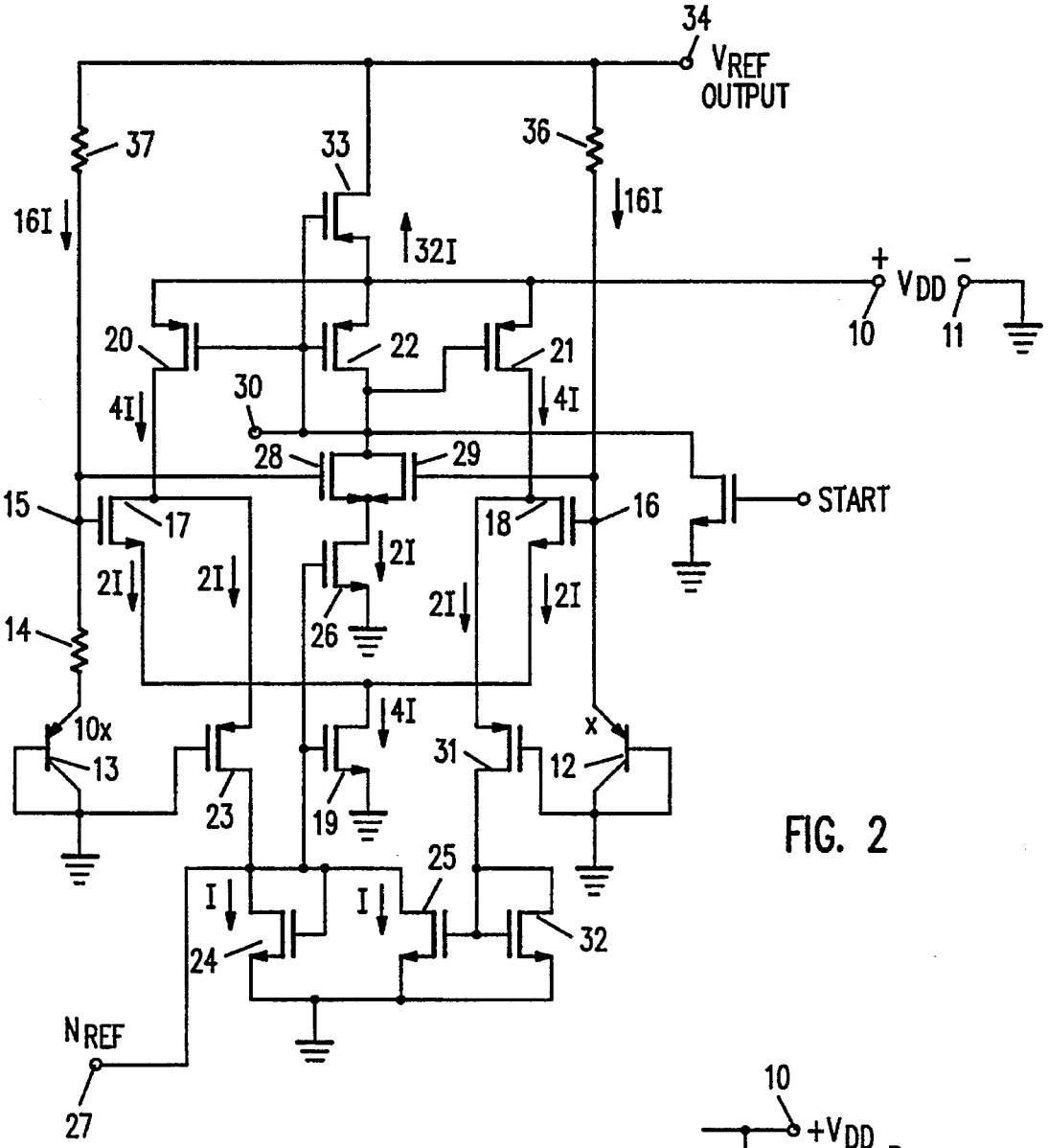
FIG. 2 is a schematic diagram illustrating a CMOS version of a bandgap voltage and current generator circuit in accordance with the present invention.

FIG. 1A illustrates a simplified schematic diagram of the $\Delta V_{BE}$ portion of a bandgap voltage and current generator circuit in accordance with the present invention. In the FIG. 1A circuit, the currents $I_a$ and $I_b$ flow in PNP transistors 12 and 13, respectively. As shown in FIG. 1A, the emitter area of transistor 13 is 10 times that of transistor 12. Voltage $V_a$ is developed across transistor 12 and appears at circuit node 15. Voltage $V_b$ is developed across the series combination of transistor 13 and resistor 14 so that this voltage appears at circuit node 16. Resistors 36 and 37 function primarily to determine the levels of currents $I_a$ and $I_b$, respectively, which, in the preferred embodiment of the invention, are made equal. While not shown in FIG. 1A, but as described in detail below, and in accordance with the present invention, a comparator has its differential inputs connected to nodes 15 and 16 and its current output connected to provide the current input $I_a$ shown in FIG. 1A.

FIG. 1B is a graph plotting currents $I_a$ and $I_b$ as a function of the voltage at node 34. Note that current $I_a$ must equal current $I_b$ for voltage $V_a$ to equal voltage $V_b$ since these currents must cause equal voltage drop across equal resistors 36 and 37. The comparator, the output of which is a current rather than a voltage, acts to set the current $I_a$ to that value that causes $V_a$ to be equal to $V_b$. Such a comparator is disclosed in co-pending and commonly-assigned patent application Ser. No. 08/094,648, which was filed Jul. 21, 1993, entitled, A VOLTAGE COMPARATOR WITH CONTROLLED OUTPUT CURRENT PROPORTIONAL TO A DIFFERENTIAL VOLTAGE; the just-referenced application is hereby incorporated by reference to provide additional background regarding the present invention.

In the '648 application, the comparator uses P-channel transistors, whereas, in the embodiment described below, a complementary version using N-channel transistors is employed. N-channel comparators normally cannot operate with input signals in the desired voltage range of bandgap references (approx. 1.2 V) because insufficient overdrive voltage beyond the transistors' threshold voltage remains. However, by using native N-channel transistors with thresholds adjusted to be ~0.2 v, sufficient overdrive voltage is achieved.

With reference to FIG. 2, which is a schematic diagram illustrating a preferred embodiment of a circuit in accordance with the invention, a $V_{DD}$ power supply is connected + to terminal 10 and – to ground terminal 11. Resistors 36 and 37 supply equal currents to diode-connected PNP transistors 12 and 13, respectively. Transistor 13 has 10 times the emitter area of transistor 12. Resistor 14 is connected between the emitter of transistor 13 and circuit node 15. The collector and base of transistor 13 are connected to ground. The smaller area transistor 12 is connected between node 16 and ground. If nodes 15 and 16 are forced to the same potential and the currents flowing in transistors 12 and 13 are equal, then the $\Delta V_{BE}$ therebetween will appear across resistor 14. The foregoing describes the FIG. 1A $\Delta V_{BE}$ circuit.

As further shown in FIG. 2, N-channel transistors 17 and 18 form a long-tailed differential pair in which N-channel transistor 19 provides the constant tail current. P-channel transistors 20 and 21 are the load elements for transistors 17 and 18, respectively. A plurality of re-entrant connected current mirrors are employed to power the comparator circuit. Relative current levels, in different portions of the circuit, are indicated in units "I" and apply when the circuit achieves balance. The magnitude of current I is set by a fundamental current-mirror reference transistor 24 in combination with P-channel transistor 33, which provides the current to the $\Delta V_{BE}$-resistor network. The circuit operates to set the value of current I. The current in transistor 33, defined as 32I, forces the circuit to achieve balance. The size selection of transistor 33, which sets the current level on all of the circuit branches by its indirect current-mirror relationship with transistor 24, is described next.

Because current I flows in transistor 24, current 4I flows in the tail-current transistor 19 by mirroring and current 2I flows in P-channel transistor 22, established via N-channel transistor 26. The scaling relationship between P-reference transistor 22 and load transistors 20 and 21 sets the load currents of these latter two devices at current 4I. Transistor 22 also sets the current 32I in transistor 33 by their relative sizes.

At balance, the 4I tail current in transistor 19 is split equally between input transistor 17 and 18. Hence, only 2I of the 4I current in each load transistor 20 and 21 is satisfied. The remainder is made up by current 2I flowing through transistor 23 to transistors 24 and 25 and by 2I flowing through transistor 31 to transistor 32. Diode-connected transistor 32 reflects current I in transistor 25, thereby establishing current I as the remaining current for fundamental reference transistor 24.

Off balance, the current in transistor 24 varies, thus changing the current delivered to the $\Delta V_{BE}$ resistor network via transistor 33. The resulting difference in input voltage to transistors 17 and 18 alters the currents in transistors 24, 25 and 32 so as to bring the current in fundamental reference transistor 24 to its correct value. Note that the currents in all branches vary, as the correct value for current I is sought.

N-channel transistors 28 and 29 are optional in the circuit of FIG. 2. The reference generator functions without them (replacing them with wires); however, they act to minimize variation of $V_{REF}$ with variation in supply voltage $V_{DD}$.

The above-described bandgap reference generator has two possible stable states, one state producing the stable reference voltage $V_{REF}$, with current relationships as described above, and a second state wherein no current flows. Consequently, a start-up circuit is needed to start currents flowing to produce the desired state yielding $V_{REF}$.

Figure 3:
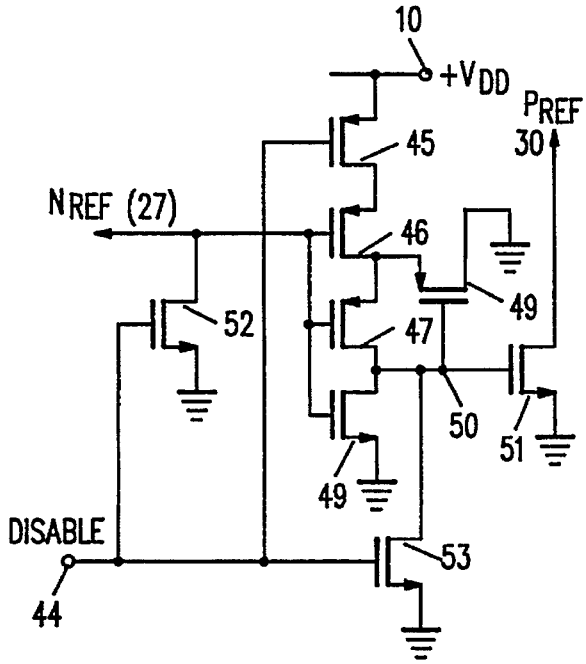
FIG. 3 is a schematic diagram illustrating an embodiment of a start-up circuit utilizable with the FIG. 2 circuit.

FIG. 3 illustrates an embodiment of a start-up circuit utilizable with the FIG. 2 circuit for the purpose of activating operation when $V_{DD}$ power is first applied or a power supply glitch interrupts operations. Without the FIG. 3 startup circuit, the FIG. 2 configuration would not be self-starting. The antomatic start-up feature can be inhibited by the potential at the disable-terminal 44. If terminal 44 is low, then start-up is automatic.

In the FIG. 3 start-up circuit, P-channel transistor 46 forms an inverter gate with N-channel transistor 48. P-channel transistors 47 and 49 provide hysteresis in the inverter gate transfer function. P-channel transistor 45 and N-channel transistors 52 and 53 provide a start-up disable function by way of DISABLE terminal 44.

When the circuit of FIG. 2 is first energized, or has been deactivated by a power supply glitch, the potential at the NREF terminal will be low. Thus, the input to the inverter in the FIG. 3 circuit will be low and node 50 will be high. This turns on N-channel transistor 51 which will act to pull the PREF terminal 30 low. This causes fundamental P-channel transistor 22 of the FIG. 2 circuit to turn on, initiating the re-entrant current mirrors of that circuit. Once the FIG. 2 circuit is operational, the NREF terminal 27 is pulled up, thereby disabling transistor 51.

The trip point for the inverter of the FIG. 3 start-up circuit is set slightly below the fundamental reference voltage at node 27 to sense when current ceases. Hysteresis is added to the inverter to minimize the possibility of oscillation if start-up transients cause node 27 to dip slightly.

EXAMPLE

The circuit of FIG. 2 may be formed using CMOS technology employing the following components:

| Component | Value/Size (W/L in Microns) |
|---|---|
| Resistor 14 | 12K ohms |
| Transistors 17, 18, 19, 20, 21, 38, 41 | 20/5 |
| Transistors 22, 26, 32 | 10/5 |
| Transistors 23, 31 | 10/2 |
| Transistors 24, 25, 28, 29 | 5/5 |
| Transistor 33 | 160/5 |
| Resistors 36, 37 | 100K ohms |

Transistors 17, 18, 28 and 29 are constructed to have low (about 0.2 volt) thresholds. The nominal $V_{DD}$ supply is 5 volts. The current designated "I" is set at 0.25 microamperes so that the current in transistors 12 and 13 is 4 microamperes. The supply voltage may be varied over the range of 6-OV.

FIG. 4 is a graph showing the performance of the FIG. 2 circuit as a function of supply voltage. It will be noted that the circuit functions well at 6 V and is still operational down to about 1.5 V. The value of the potential at terminal 34 is 1.125 volts ±2% over the 1.5–6 V supply range, and is substantially independent of temperature over the range of −40° to 125° C.

It should be understood that various alternatives to the embodiments of the invention described herein may be employed in practicing the invention. It is intended that the following claims define the scope of the invention and that methods and circuits within the scope of these claims and their equivalents be covered thereby.

What is claimed is:

1. A bandgap voltage generator circuit that provides a substantially constant reference voltage at an output terminal of the bandgap voltage generator circuit, the reference voltage being substantially independent of supply voltage, temperature and semiconductor processing, the bandgap voltage generator circuit comprising:

a first PN junction device connected between a ground terminal and a first circuit node;

a second PN junction device connected to the ground terminal and to a second circuit node via a first resistor;

a second resistor coupled between the first circuit node and the output terminal;

a third resistor connected between the second circuit node and the output terminal;

means for ratioing the current densities in the first and second PN junction devices such that a differential voltage is developed between the first and second PN junction devices, the first PN junction device developing the higher voltage;

a comparator having an output node coupled to the output terminal, and having first and second input terminals coupled, respectively, to the first and second circuit nodes such that the comparator drives the output terminal to a potential that results in equal voltage drops across the second and third resistors; and re-entrant connected current mirror circuitry connected to the comparator for powering the comparator to establish an output current flowing in the second and third resistors, the output current having a value that results in a voltage balance at the first and second circuit nodes.

2. A bandgap voltage generator circuit as in claim 1 and wherein the re-entrant connected current mirror circuitry includes a fundamental current mirror reference connected to the comparator and that responds to a first reference signal by providing a current source for the comparator.

3. A bandgap voltage generator circuit as in claim 2 and wherein the re-entrant connected current mirror circuitry further includes dynamic adjustment means connected to the fundamental current mirror reference for adjusting current flow in the fundamental current mirror reference so as to alter fundamental unit current in the bandgap voltage generator circuit.

4. A bandgap voltage generator circuit as in claim 1 and further comprising start-up circuitry connected to the re-entrant connected current mirror circuitry and responsive to a low potential in the re-entrant connected current mirror circuitry for providing a turn-on signal to the re-entrant connected currant mirror circuitry to initiate operation of the re-entrant connected current mirror circuitry.

5. A bandgap voltage generator circuit that provides a substantially constant reference voltage at an output terminal of the bandgap voltage generator circuit, the reference voltage being substantially independent of supply voltage, temperature and semiconductor processing, the bandgap voltage generator circuit comprising:

a first pnp transistor having its emitter connected to a first circuit node and its base and collector commonly connected to a ground terminal;

a second pnp transistor having its base and collector commonly connected to the ground terminal and its emitter coupled to a second circuit node via a first resistor;

a second resistor connected between the first circuit node and the output terminal;

a third resistor connected between the second circuit node and the output terminal;

the emitter sizes of the first and second pnp transistors being ratioed such that a differential voltage is developed between the first and second pnp transistors, the first pnp transistor developing the higher voltage;

a comparator that includes a first n-channel transistor having its gate connected to the first circuit node, a second n-channel transistor having its gate connected to the second circuit node, the sources of the first and second n-channel transistors connected to a common node, and a n-channel tail current transistor having its drain connected to the common node, its source connected to the ground terminal, and its gate connected to a low potential reference node; and re-entrant connected current mirror circuitry that includes a fundamental n-channel current mirror reference transistor having its source connected to the ground terminal and its drain and gate commonly connected to the low potential reference node.

6. A bandgap voltage generator circuit as in claim 5 and further comprising:

a p-channel current source transistor having its source connected to a positive power supply terminal, its drain connected to the output terminal, and its gate connected to a start-up node;

a first p-channel load transistor having its source connected to the positive power supply terminal, its drain connected to the drain of the first n-channel transistor, and its gate connected to the start-up node;

a second p-channel load transistor having its source connected to the positive power supply terminal, its drain connected to the drain of the second n-channel transistor, and its gate connected to the start-up node;

a p-channel reference transistor having its source connected to the positive power supply terminal and its drain and gate commonly connected to the start-up node; and a third n-channel transistor having its source connected to the ground terminal, its drain coupled to the start up node and its gate connected to the low potential reference node.

7. A bandgap voltage generator circuit as in claim 6 and further comprising a fourth n-channel transistor having its source connected to the drain of the third n-channel transistor, its drain connected to the start-up node and its gate connected to the first circuit node and a fifth n-channel transistor having its source connected to the drain of the third n-channel transistor, its drain connected to the start-up node and its gate connected to the second circuit node.

8. A bandgap voltage generator circuit as in claim 6 and further comprising:

a first p-channel transistor having its source connected to the drain of the second n-channel transistor, its drain connected to the low potential reference node and its gate connected to the ground terminal;

a sixth n-channel transistor having its source connected to the ground terminal and its drain connected to the low potential reference node;

a seventh n-channel transistor having its source connected to the ground terminal and its gate and drain commonly connected to the gate of the sixth n-channel transistor; and a second p-channel transistor having its source connected to the drain of the first n-channel transistor, its drain connected to the commonly connected gates of the sixth and seventh n-channel transistors, and its gate connected to the ground terminal.

9. A bandgap voltage generator circuit as in claim 6 and further comprising a start-up circuit connected to the low potential reference node and that responds to a low potential at the low potential reference node by providing a start-up signal to the start-up node such that operation of the re-entrant connected current mirror circuitry is initiated.

* * * * *